US005890673A

United States Patent [19]

Enderle et al.

[11] Patent Number: 5,890,673

[45] Date of Patent: Apr. 6, 1999

[54] COILING ASSEMBLY HAVING COILING STATIONS OF DIFFERING CONSTRUCTION FOR COILING WEBS OF DIFFERING CHARACTERISTICS

[75] Inventors: Ralf Enderle; Ewald Kunz, both of Darmstadt, Germany

[73] Assignee: Maschinenfabrik GOEBEL GmbH, Darmstadt, Germany

[21] Appl. No.: 836,463

[22] PCT Filed: Oct. 2, 1996

[86] PCT No.: PCT/DE96/01899

§ 371 Date: May 16, 1997

§ 102(e) Date: May 16, 1997

[87] PCT Pub. No.: WO97/12825

PCT Pub. Date: Apr. 10, 1997

[51] Int. Cl.[6] ..... B65H 35/02; B65H 18/08; B65H 18/14

[52] U.S. Cl. ..... 242/531.1; 242/525; 242/542.3

[58] Field of Search ..... 242/525, 531.1, 242/542.3, 530

[56] References Cited

U.S. PATENT DOCUMENTS

| | | | |
|---|---|---|---|
| 817,025 | 4/1906 | White | 242/530 |
| 2,449,234 | 9/1948 | Knoble | 242/531.1 |
| 3,883,085 | 5/1975 | Held | 242/530.4 |
| 4,175,713 | 11/1979 | Jores | 242/531.1 |
| 4,374,575 | 2/1983 | Lerch et al. | 242/530 |
| 4,508,283 | 4/1985 | Beisswanger | 242/530 |
| 4,695,005 | 9/1987 | Gietman, Jr. | 242/531.1 X |

FOREIGN PATENT DOCUMENTS

| | | |
|---|---|---|
| 0616965 | 9/1994 | European Pat. Off. . |
| 2506235 | 9/1996 | Germany . |

*Primary Examiner*—John Q. Nguyen
*Attorney, Agent, or Firm*—Watson Cole Grindle Watson, P.L.L.C.

[57] ABSTRACT

A coiling assembly for coiling webs of differing characteristics into a roll comprising first and second coiling station different from each other and a guide mechanism for guiding a moving web to one of the first and second coiling station.

7 Claims, 1 Drawing Sheet

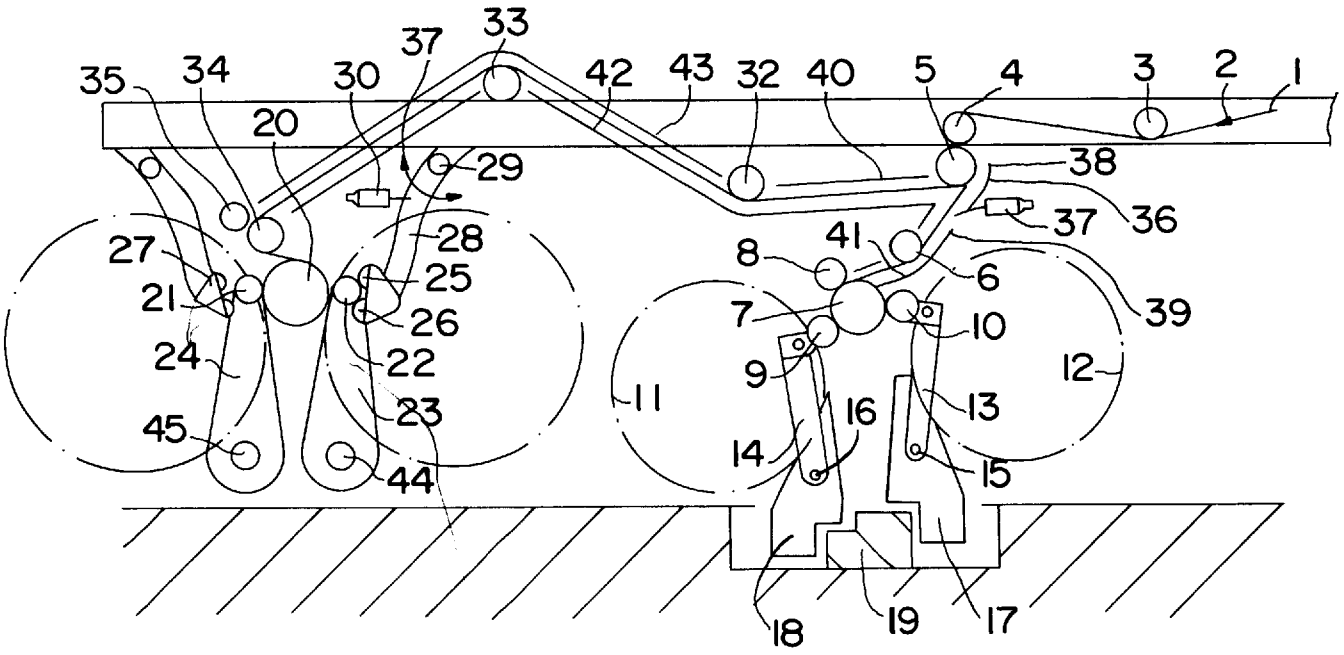
1
2
3
4
5
40
32
43
42
33
37
30
35
34
20
29
28
25
26
22
23
44
27
21
24
45
38
36
37
39
12
6
10
13
15
17
19
41
16
18
8
7
9
14
11

COILING ASSEMBLY HAVING COILING STATIONS OF DIFFERING CONSTRUCTION FOR COILING WEBS OF DIFFERING CHARACTERISTICS

BACKGROUND OF THE INVENTION

1. Field of the Invention

This invention relates to apparatus for the coiling of a moving a band web or strips which are cut from the band.

2. The Prior Art

Mechanical assemblies for the coiling of bands, or strips cut from the bands, are known, as shown for example in U.S. Pat. No. 817,025. In this patent, band-like material is first pulled off a roll in order to be fed to a longitudinal cutter. The original full width of the band on the uncoiling roll is cut in this longitudinal cutter by longitudinal cutting, that is, by cutting in the moving direction of the band, into individual, narrower strips. These strips run alternately to one of two coiling positions, whereby each coiling position is formed by two so-called idlers, that is, rollers on which at least one roll forming due to the coiling process can be supported by its own weight, for example. Since two coiling positions with two carrying rolls each are utilized, it is possible to feed one strip, to one coiling position with one pair of carrying rolls and the other, for example adjacent strip to the other pair of carrying rolls of the other coiling position. In this way, at least two relatively narrow rolls are coiled at the same time at the two coiling positions, whereby the sum of the widths of the rolls coiled in each case is identical to the width of the originally uncoiled band.

Another construction of idlers is shown for example in German Patent 25 06 235. Also in this case, an originally wide band is cut in a longitudinal cutter into narrower so-called strips, whereby each of the strips obtained is fed alternately to one of two coiling positions. In this case as well, the coiling positions are produced by two idlers, in particular by one pair of idlers in each case. The strips obtained from the wide band by longitudinal cutting are each coiled into a roll, whereby devices are provided to press each roll forming during the coiling process against the two idlers of each pair of idlers. In this way, the quality of the coiled rolls can be influenced.

Another type of mechanical device to coil strips obtained by longitudinal cutting from an originally wide band into rolls is shown in U.S. Pat. No. 3,883,085. In this case, a so-called supporting roller coiler is shown that has only one coiling position, however, whereby two groups of rolls forming can be supported on a common pressure roller during the coiling process. But other supporting roller coilers are also known that comprise several supporting rollers, preferably one supporting roller per group of rolls forming. For example, U.S. Pat. No. 4,374,575 shows such a device in which the originally wide band at least partially wraps around a central cylinder or roller in such a way that the individual narrow strips obtained by longitudinal cutting from the wide band can each run to one side to one group of rolls forming. In so doing, each group of rolls forming or each individual roll is assigned to a separate pressure roller, in such a way that at least two pressure rollers parallel to each other are present in the machine. However, this machine is basically nothing more than a machine with essentially one coiling position, that is, the originally wide band runs to this coiling position is divided only here into narrower strips in such a way that each strip can be individually rolled into a roll on its own.

A mixed form of supporting roller coiler and idler coiler is shown in European Patent Application 0 616965, wherein the individual rolls forming by coiling of strips are each supported by a pair of relatively small idlers against a common support cylinder. This mixed form of supporting roller coiler and idler coiler also only forms one coiling position however, because in this case as well, the originally wide band is cut only at this coiling position into individual strips in such a way that the strips obtained by the cutting process can be coiled alternately in the one idler bed or in the other idler bed.

Another mixed form of supporting roller coiler and idler coiler is shown in U.S. Pat. No. 4,508,283. Also in this case as the strips obtained by longitudinal cutting of a band are alternately fed to one or the other side of a common support cylinder, whereby the cutter is arranged immediately at or in the vicinity of the support cylinder, however. This known device also forms essentially only one coiling position. All of these known coiling machines have in common that rolls of different widths are to be coiled on them alternately. Based on customer wishes, wider or narrower strips are to be coiled into rolls in such a way that wider or narrower rolls are produced. Since the customer's wishes change frequently, however, it is typical to cut either relatively narrow or relatively wide strips and coil them into one roll, depending on what the customer wishes. But to design the respective machine so that it can be utilized for general purpose, however, the cutters and holders for the respective strips or rolls must be placed and attached differently within the machine, as the customer wishes. For this, conversion work is necessary, which means a corresponding loss of production for the machine. It is therefore necessary to keep this loss of production. as short as possible, which means avoiding it altogether as far as possible. For this reason, a device is needed that makes it possible to feed the band not yet cut into strips by longitudinal cutting to one or another coiling position at any given time, in such a way that the mechanical device of the one or the other coiling position is free for corresponding conversion works, and during conversion or adjusting of the one coiling position, the production of the mechanical device can continue at the other coiling position without interrupting production as far as possible, and to thereby further increase the mechanical device's availability as much as possible.

SUMMARY OF THE INVENTION

According to the present invention a coiling apparatus includes two coiling stations, at least one of the coiling stations including a supporting roller coiler, and guide rollers and guide plates providing guide channels for delivering a moving band or web to one or the other of the two coiling stations. Each coiling station can include cutting elements to divide the moving band or web into multiple strips which are also coiled.

Further features and advantages of the invention will become apparently by reference to the accompanying figure taken with the following discussion.

BRIEF DESCRIPTION OF THE FIGURE

The figure schematically depicts a coiling assembly in accordance with a preferred embodiment of the invention.

DETAILED DESCRIPTION OF THE PREFERRED EMBODIMENT

Referring to the accompanying figure, band 1 of paper, foil, tissue, metal, plastic or the like runs in the direction of the arrow 2 over guide rollers 3, 4, 5 and 6 to a deflection roller 7. The deflection roller 7 can work with at least one upper blade 8 in such a way that the deflection roller 7 and the at least one upper blade 8 represent a cutting device that is able to separate into individual narrower strips the band which is still in its full width or essentially full width and not yet divided, running in the moving direction of the band 1, i.e., in the direction of the arrow 2. Each strip obtained by the deflection roller 7 with the at least one upper blade 8 representing altogether a longitudinal cutter runs at least partially around the deflection roller 7, then wraps around either the supporting roller 9 or the supporting roller 10, to then be coiled in typical manner into a roll 11 or a roll 12. Several upper blades 8 can be arranged side-by-side. In addition, it is possible for several supporting rollers 9 and several supporting rollers 10 to be arranged side-by-side as is already known. Each roll 12 or the coiling shaft or the coiling tube assigned to it is rotatably supported with the aid of at least one support arm 13 during the coiling process. Each roll 11 is rotatably supported with the aid of at least one support arm 14 during the coiling process. Several support arms 13 and 14 may be arranged side-by-side, for example in such a way that two such support arms can support a forming roll and the coiling shaft or coiling tube assigned to it. In addition, the support arms 13 and 14 are equipped with devices that allow the respective forming roll to press against the related supporting rollers 9 and 10 in such a way that the rolls 11 and 12 and, should the occasion arise, further rolls, can be coiled flawlessly. For this purpose, the support arms 13 and 14 are swivel mounted by means of hinges 15 and 16 on slides 17 and 18. The slides 17 and 18 are supported on a guide 19, for example, in such a way that the support arms 13 and 14 can be shifted in the viewing direction of the figure depending on the width of the respective strips being coiled into the rolls 11 and 12 and can be fixed at the desired position. The positions of elements 6 through 19 represent in their entirety a first coiling station. In addition, the inventive assembly includes a second coiling station which includes a supporting roller 20, for example. Forming rolls 21 and 22 can be supported during the coiling process on this supporting roller, for example. For this purpose, the roll 22 is held and rotatably supported by means of at least one support lever 23 and the roll 21 by means of at least one support lever 24 during the coiling process. The pressing of the forming roll or the forming rolls 22 takes place by means of two supporting rollers 25 and 26 which are rotatably mounted in a frame 27. The frame 27 can be swung by means of a swivelling lever 28 around the fixed fulcrum 29 by means of a pressure roller 30 in the direction of the arrow 31. The roll 21 or rolls 21 are attached and supported in similar manner as the roll 22. The band 1 can be fed by means of guide rollers 32, 33 and 34 to the second coiling station. Here and only here can a cutting device with upper blade 35 divide the band 1 into individual narrower strips, in such a way that they can be coiled up into either the roll 21 or the roll 22. For example, the guide roller 34 can at the same time be the lower blade for the upper blade 35. In addition, it is possible to arrange several upper blades 35 side-by-side in such a way that more than two strips can be cut from the band 1. In addition, it is possible to arrange several rolls 21 and several rolls 22 side-by-side in such a way that rolls of different widths can be coiled from strips of different widths. The figure also shows a switch 36 which can be swivelled around the fulcrum 38 by means of a pressure roller 37. The switch 36, which operates as a deflection device for the band 1, may also be equipped with a blade that is able to cut through the entire band 1 crosswise to its moving direction if necessary. In addition, the switch 36 can be swivelled in such a way that the band 1 can run essentially in its full width either to a guide channel 39 or to a guide channel 40. The guide channel 39 guides the band 1 in its full width to the first coiling station, while the guide channel 40 guides the band 1 in its full width to the second coiling station. The guide channels 39 and 40 may consist of guide plates or guide rods, whereby it is ensured that the band is pushed through or dragged through the respective guide channel until reaching the given coiling station. This can take place, for example, in that air nozzles able to carry the band are arranged diagonally to the moving direction on the inside of the respective guide channels, to thereby guide or drive the band by airflow to the given coiling station. In addition, other types of band guiding are possible, for example traction belts or so-called draw-in devices. In simple cases, it may already be sufficient to use a simple carrying plate on one-side of the band or a carrying rod or the like to feed the band to the given coiling station. In this case, the so-called guide channel would become a simple path on which the band 1 is able to slide to the given coiling station. Because the first and the second coiling station for the band 1 or the strips cut from it are arranged behind the switch 36 in the moving direction indicated by the arrow 2 and, in addition, at least one cutting device consisting of the at least one upper blade 8 and the deflection roller 7 is assigned to the first coiling station and the cutting device with the at least one upper blade 35 and the guide roller 34 is assigned to the second coiling station, there is the possibility to guide the band 1 in its moving direction not only over the guide rollers 3 and 4 essentially in its full width up to the guide roller 5, but furthermore, depending on the station of the switch 36 essentially up to the deflection roller 7 or, in the other case, up to the guide roller 34. Only at the cutting devices with the upper blade 8 and the deflection roller 7 or, in the other case, with the upper blade 35 and the deflection roller 34, is the band 1 essentially present in its full width cut into individual strips in its moving direction in such a way that these individual strips can each be coiled into rolls. By switching the switch 36 into the one or the other direction, it is possible to use either the first coiling station or the second coiling station to coil up the band 1 or its parts. The respective unused coiling or the mechanical device there can be prepared for a new coiling process, i.e., the cutting device, the mountings for the forming rolls, etc. can be set to other widths, i.e., to other formats, while production continues uninterrupted at the other coiling station. In addition, it is possible to provide at any given time the same kind of coiling devices at both coiling station; but it is possible, as shown in the disclosed embodiment, to provide different types and designs of coiling devices at one or the other coiling station. In this way, it becomes possible to coil at any given time different bands 1 of different materials, for example either only at the one coiling station or only at the other coiling station. In this way, the proposed device can be used more generally than previous devices. It is also possible to drop all support levers 24, for example in such a way that coiling can only be done on one side of the support roller 20. It is also possible to adjust the one coiling station—the first one, for example in—such a way that the support arms 13 and 14 are stationary at specific station along the guide 19 or to dispense with a slide guide of the guide 19 altogether in such a way that a quasi-fixedformat operation can be adhered to for a specific sequence of coiling procedures. It is also possible, for example, to adjust the fixing of the slides 17 and 18 only for a respective longer duration of operation to another format, i.e., to another width of rolls to be coiled. It is also possible to adjust the support arms 13 and 14 and the support levers 23 and 24 in such a way that, for example, the support arms 13 and 14 keep a different distance or different distances from each other than is the case for the support levers 23 and 24. In the extreme case, in one coiling station, e.g., in the second coiling station, the full width of the band 1 can be coiled up, whereas the first coiling station is adjusted to coil certain narrower strips obtained from the band into relatively narrow rolls 11 and 12. The guide channel 39 includes the guide plate 41, for example, and the guide channel 40 includes the guide plates 42 and 43, for example. So that the support levers 23 and 24 can be guided appropriately, they are provided with hinges 44 and 45 around which they can be swivelled. In the moving direction of the band 1 indicated by the arrow 2, the second coiling station is situated seen in the moving direction clearly on the outside behind the first coiling station, although both coiling station can be operated alternately by means of the band deflection device produced by the switch 36. Unlike an idler coiler which comprises at least one but usually two idlers that receive the weight of at least one roll forming due to the coiling process and that carry at least one roll supporting it from below, so to speak, the so-called supporting roller coiler, as another kind of coiling device in the meaning of the present invention, has at least one roller or the like, against which the at least one roll forming during the coiling process can lean, i.e., essentially can be supported. Such a supporting roller coiler forms a coiling station in the meaning of the present invention; this coiling station may in turn comprise several groups of forming rolls. At least two such coiling station should be arranged essentially one behind the other in the moving direction of the band 1. The band 1 can also be cut straight, i.e., trimmed at its edges already before passing the deflection device, for example, something that essentially does not affect its width. It is also possible to operate the proposed device, with corresponding design of the deflection device (switch 36) and using a corresponding longitudinal cutter, in such a way that at any given time a part of the band 1 or at any given time at least a strip cut out of the band 1 is coiled at the same time at both coiling station. This increases the availability and the multiplicity of possibilities of use or utilization of the proposed mechanical device. To avoid unnecessary repetition and to describe the present invention as briefly as possible, the previous publications cited concerning the state of the art are referred to expressly to support and complete the present description. In addition, if necessary more than two coiling station can be provided in the moving direction of the band on the outside one behind the other, though increasing the expense accordingly. In the meaning of the present invention, an idler, for example, represents a certain kind of coiling machine and a supporting roller coiler, for example, represents another kind.

List of parts

1 band
2 arrow
3 guide roller
4 guide roller
5 guide roller
6 guide roller
7 deflection roller
8 upper blade
9 supporting roller
10 supporting roller
11 roll
12 roll
13 support arm
14 support arm
15 hinge
16 hinge
17 slide
18 slide
19 guide
20 supporting roller
21 rolls
22 rolls
23 support lever
24 support lever
25 supporting roller
26 supporting roller
27 frame
28 swivelling lever
29 fulcrum
30 pressure roller
31 arrow
32 guide roller
33 guide roller
34 guide roller
35 upper blade
36 switch
37 pressure roller
38 fulcrum
39 guide channel
40 guide channel
41 guide plate
42 guide plate
43 guide plate
44 hinge
45 hinge

SUMMARY

To be able to make good use of a device for coiling, at least one coiling station is occupied by a supporting roller coiler.

What is claimed is:

1. A coiling assembly for coiling webs of differing characteristics into a roll which comprises:

a first coiling station that includes first and second supporting rollers around which a web can be wounds a deflection roller for conveying a web to one of said first and second supporting rollers for coiling thereon, first and second slides, first and second pivotable support arms which are respectively connected between said first and second slides and said first and second supporting rollers to enable movement of said respective first and second supporting rollers away from said deflection roller, and a guide alone which said first and second slides are movable parallel to axes of said respective first and second supporting rollers, a second coiling station that includes a third supporting roller, first and second forming rolls on which a web from said third supporting roller can be wound, first and second pressing rollers contacting a web on said first forming roll, and third and fourth pressing rollers contacting a web on said second forming roll, and means for guiding a moving web to one of said first and second coiling stations.

2. A coiling assembly according to claim 1, including third and fourth pivotable support arms respectively connected to said first and second forming rolls to enable movement thereof away from said third supporting roller.

3. A coiling assembly according to claim 2, wherein said first coiling station includes cutting means opposite said deflection roller for cutting said web into at least two parallel strips for coiling on at least one of said first and second supporting rollers.

4. A coiling assembly according to claim 1, wherein said second coiling station includes cutting means for cutting said web into at least two parallel strips for coiling on at least one of said first and second forming rolls.

5. A coiling assembly according to claim 1, wherein said guiding means comprises guide rollers over which said web passes and guide plates which define guide channels through which said web passes.

6. A coiling assembly according to claim 5, including switch means for controlling to which of said first and second coiling station said moving web is guided.

7. A coiling assembly according to claim 6, wherein said switch means includes a deflecting element and a pressure cylinder connected to said deflecting element to move said deflecting element around a pivot.

* * * * *